US005842090A

United States Patent [19]

Mikawa

[11] Patent Number: 5,842,090

[45] Date of Patent: Nov. 24, 1998

[54] DEVELOPING DEVICE HAVING A MEMBER FOR RESTRICTING TRANSPORT OF DEVELOPER

[75] Inventor: Susumu Mikawa, Takarazuka, Japan

[73] Assignee: Minolta Co., Ltd., Osaka, Japan

[21] Appl. No.: 843,747

[22] Filed: Apr. 21, 1997

[30] Foreign Application Priority Data

Apr. 22, 1996 [JP] Japan ..... 8-126496

[51] Int. Cl.[6] ..... G03G 15/08

[52] U.S. Cl. ..... 399/256; 222/167; 366/318; 366/323; 399/254

[58] Field of Search ..... 399/254, 255, 399/256, 258; 222/DIG. 1, 167; 366/279, 291, 292, 297, 298, 314, 318, 323, 329.1, 343

[56] References Cited

U.S. PATENT DOCUMENTS

| | | | |
|---|---|---|---|
| 4,405,239 | 9/1983 | Chung et al. | 366/323 X |
| 4,980,724 | 12/1990 | Tanaka | 399/256 |
| 4,989,539 | 2/1991 | Ichikawa | 399/256 |
| 5,510,883 | 4/1996 | Kimura et al. | 399/256 |
| 5,682,583 | 10/1997 | Ito et al. | 399/254 |

FOREIGN PATENT DOCUMENTS

| | | |
|---|---|---|
| 60-133484 | 7/1985 | Japan . |
| 3-265877 | 11/1991 | Japan . |
| 3-266864 | 11/1991 | Japan . |
| 4-072894 | 3/1992 | Japan . |
| 4-182682 | 6/1992 | Japan . |
| 5-127519 | 5/1993 | Japan . |

*Primary Examiner*—Arthur T. Grimley
*Assistant Examiner*—Sophia S. Chen
*Attorney, Agent, or Firm*—Sidley & Austin

[57] ABSTRACT

A developer mixing and transporting member is provided which has at least two independent spiral-shaped channels extending around the circumference of the member. At least one of the channels is partly blocked by an element which restricts developer transport through the channel so that developer being mixed and transported within each of the channels is transported at different speeds and is thus rapidly mixed.

20 Claims, 8 Drawing Sheets

DEVELOPING DEVICE HAVING A MEMBER FOR RESTRICTING TRANSPORT OF DEVELOPER

BACKGROUND OF THE INVENTION

1. Field of the Invention

The present invention relates to a developing device for use in image forming apparatuses such as copying machines, printers and the like, and specifically relates to developing devices which mix and transport developer within the device body by means of a driven developer mixing and transporting member provided within the developing device body.

2. Description of the Related Art

Various types of developing devices are conventionally used to accomplish developing in image forming apparatuses such as copying machines, printers and the like.

One known type of such a developing device, shown in FIG. 1, is provided with a developing sleeve 11 to transport developer to an image bearing member 1 which is provided so as to be rotatable at an opening of the device body 10 facing said image bearing member 1, and a partition 12 disposed along the axial direction of developing sleeve 11 within the device body 10, such that said partition 12 separates a first transport path 13*a* facing developing sleeve 11 and a second transport path 13*b* separated from developing sleeve 11 within device body 10, and rotatable developer mixing and transporting members 14 disposed within said first transport path 13*a* and said second transport path 13*b*.

In this developing device, each developer mixing and transporting member 14 is rotated within the respective first transport path 13*a* and second transport path 13*b*, so as to mix developer within said first transport path 13*a* and transport said developer along the axial direction of the developing sleeve 11, and supply part of said developer to developing sleeve 11 to deliver said developer to the image bearing member 1 by means of developing sleeve 11 and supply toner to said image bearing member 1 to develop an electrostatic latent image formed thereon on the one hand, and mix developer within said second transport path 13*b* separated from the developing sleeve 11 and transport said developer in the opposite direction relative to said first transport path 13*a* to pass through openings 12*a* formed at bilateral ends of partition 12 so as circulate the developer between said first transport path 13*a* and said second transport path 13*b*.

In this developing device, when there is a decrease in the amount of toner in the developer as a result of the previously described developing operation, fresh toner is resupplied to toner replenishment unit 15 which extends laterally at said second transport path 13*b*. The resupplied toner is mixed and transported with developer within said second transport path 13*b* by the previously mentioned developer mixing and transporting member 14 and delivered to transport path 13*a* so as to circulate between said first transport path 13*a* and said second transport path 13*b*.

Conventionally, blade members 14*c* forming one or more spiral-shaped channels 14*b* on a rotating shaft 14*a*, as shown in FIGS. 1 and 2, are used as a developer mixing and transporting member 14 disposed in the aforementioned first transport path 13*a* and second transport path 13*b* to mix and transport developer, so as to transport developer along channel 14*b* while mixing said developer via the blade members 14*c* provided on the circumference of rotating shaft 14*a* in conjunction with the rotation of said rotating shaft 14*a* of developer mixing and transporting member 14.

Although the aforesaid developer mixing and transporting member 14 has a weak ability to mix the developer, it has an excellent ability to transport developer. Therefore, it is difficult to adequately mix and triboelectrically charge resupplied toner with the carrier during the time while fresh toner is resupplied to toner replenishment unit 15 and the resupplied toner is mixed and transported with developer within the second transport path 13*b* by the developer mixing and transporting member 14 so as to be delivered to the first transport path 13*a* to be supplied to developing sleeve 11 for use in developing. Particularly in the case of high speed apparatuses wherein resupplied toner and developer are mixed for a short time before being used for developing, the resupplied toner cannot be adequately charged before the toner is used for developing. Because the toner is inadequately charged, the formed image will display a fog. An additional effect is airborne dispersion of the toner.

Since the aforementioned developer mixing and transporting member 14 transports developer at constant speed along the channel 14*b* while mixing the resupplied toner and developer within the second transport path 13*b* by means of the blade member 14*c*, some time is required to uniformly disperse the freshly resupplied toner in the developer in the first transport path 13*a* and second transport path 13*b*. Until the resupplied toner is uniformly dispersed the concentration of toner in the developer differs in various parts of the device body 10 and causes irregular density in the formed images.

SUMMARY OF THE INVENTION

An object of the present invention is to eliminate the previously described disadvantages by providing an developing device for use in image forming apparatuses such as copying machines, printers and the like, wherein a developer mixing and transporting member provided within the device body is driven so as to mix and transport developer within the device body via said developer mixing and transporting member.

Another object of the present invention is to provide a developing device that stably produces formed images without fog or irregular density by rapidly uniformly mixing and charging developer.

These objects are attained by providing a developing device provided with: a mixing and transporting member; a plurality of channels provided on the mixing and transporting member to transport developer; and a restricting member provided within one channel of the plurality of channels to restrict developer transport.

The aforesaid construction provides adequate mixing of the developer by means of the different transport speeds and different amounts of developer transported by the channel with the restricting member and channels without the restricting member.

Another construction of the developing device of the present invention provides: a mixing and transporting member which is rotatably provided; a first channel provided on the mixing and transporting member to mix and transport developer at a predetermined transport speed; and a second channel provided on the mixing and transporting member to mix and transport developer at a different transport speed than the transport speed of the first channel.

This construction rapidly and reliably mixes developer by the different transport speed of developer transported by said first and second channels.

BRIEF DESCRIPTION OF THE DRAWINGS

These and other objects and features of this invention will become clear from the following description, taken in conjunction with the preferred embodiments with reference to the accompanied drawings in which.

DETAILED DESCRIPTION OF THE PREFERRED EMBODIMENTS

The preferred embodiments of the developing device of the present invention are described hereinafter with reference to the accompanying drawings.

Figure 3:
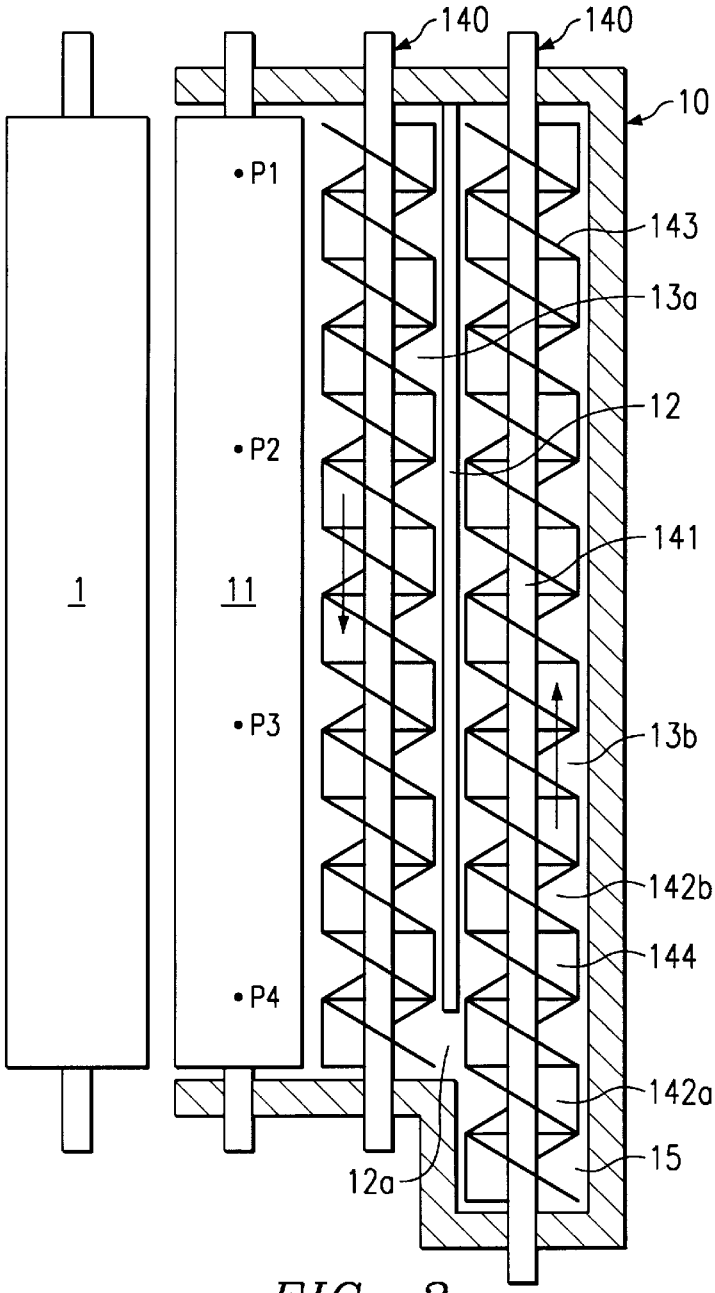
FIG. 3 briefly shows developing by a developing device of one embodiment of the present invention.
Figure 4:
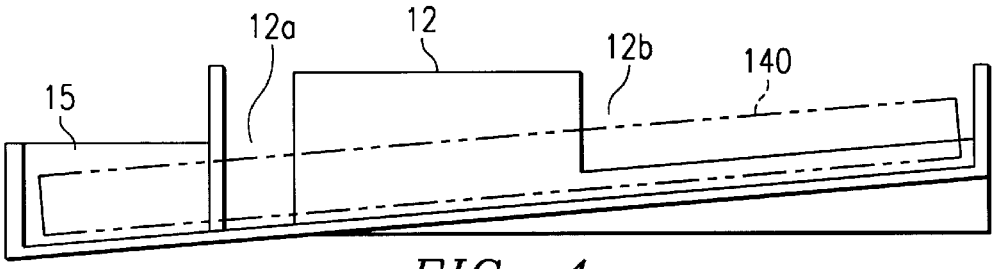
FIG. 4 briefly shows a partition provided within the developing device body in the developing device of the same embodiment.

The developing device of the present embodiment shown in FIGS. 3 and 4 is provided with a developing sleeve 11 to transport developer to an image bearing member 1 which is disposed so as to be rotatable at an opening of the device body 10 so as to confront the image bearing member 1. A partition 12 is disposed along the axial direction of developing sleeve 11 within the device body 10, such that the partition 12 separates a first transport path 13*a*, facing developing sleeve 11, and a second transport path 13*b* separated from developing sleeve 11 within device body 10, and rotatable developer mixing and transporting members 140 disposed within the first transport path 13*a* and the second transport path 13*b*.

Figure 5:
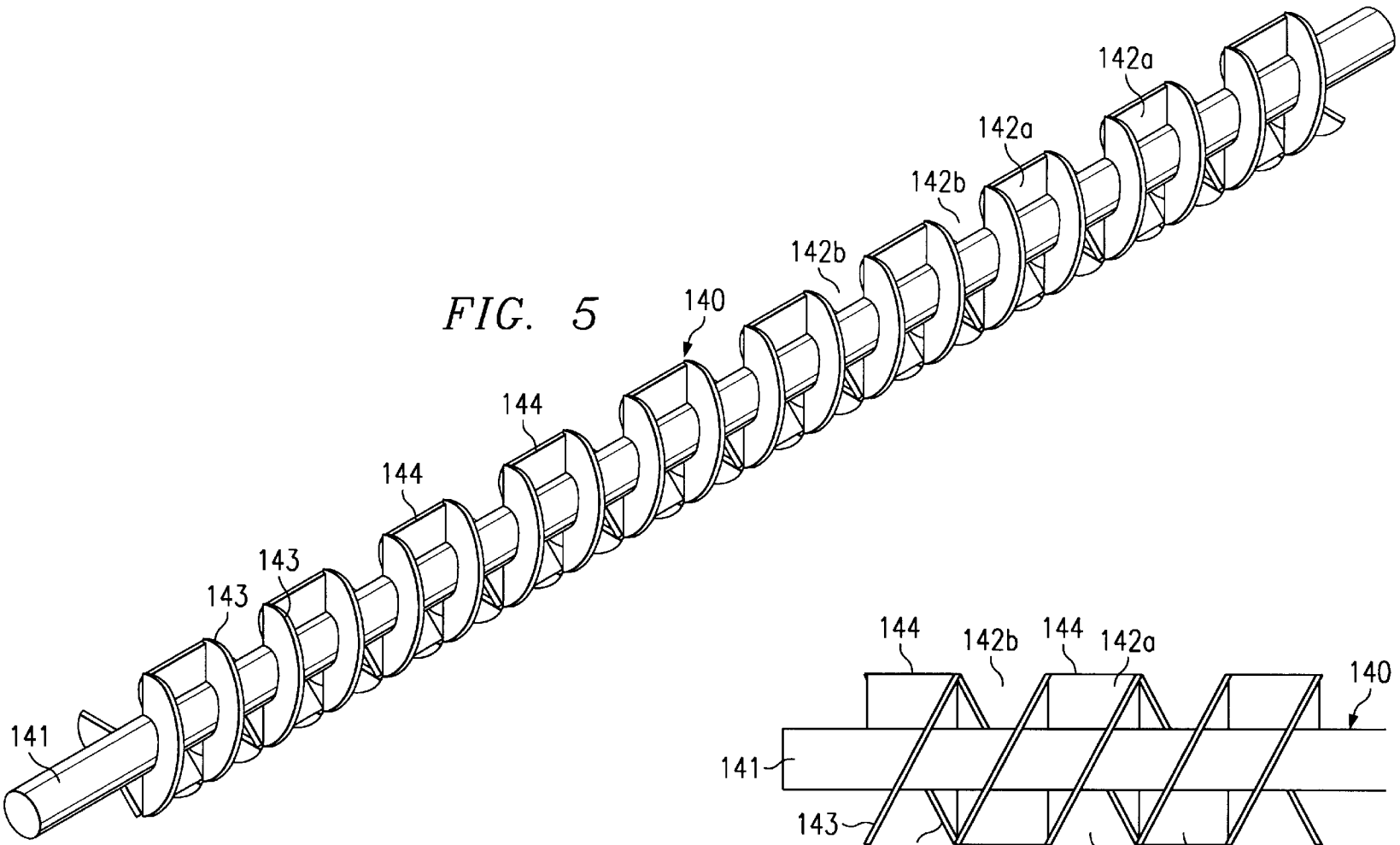
FIG. 5 briefly shows the developer mixing and transporting member used to mix and transport developer in the developing device of the same embodiment.
Figure 6:
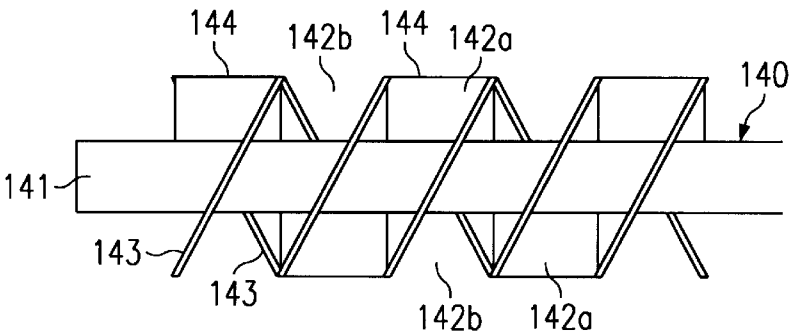
FIG. 6 is a partial view of the developer mixing and transporting member used to mix and transport developer in the developing device of the same embodiment.

In the developing device of the present embodiment, as shown in FIGS. 5 and 6, a blade member 143, comprising two spiral-shaped channels 142*a* and 142*b* formed on the circumference of a rotating shaft 141, is provided as a developer mixing and transporting member 140 disposed in the first transport path 13*a* and second transport path 13*b*. The device uses a restricting member 144, having the same height as blade members 143 provided between the blade members 143, so as to restrict transport of developer between blade members 143 which form one spiral-shaped channel 142*a*. The restricting member 144 is not provided between the blade members 143 forming spiral-shaped channel 142*b*.

In the developing device of the present embodiment shown in FIGS. 3 and 4, the first transport path 13*a* and second transport path 13*b* are separated by partition 12 within developing device body 10, and an opening 12*a* is provided at one end of partition 12 to guide developer from first transport path 13*a* to second transport path 13*b*, and a space 12*b* is provided, that is, the height of partition 12 is reduced from the center portion of partition 12 toward the side opposite of said opening 12*a*, so as to allow developer to pass over partition 12 from the second transport path 13*b* to the first transport path 13*a*.

In this developing device, each developer mixing and transporting member 140 provided in first transport path 13*a* and second transport path 13*b* are rotated to mix developer and transport said developer along the axial direction of developing sleeve 11 in first transport path 13*a* opposite developing sleeve 11, and part of the developer is supplied to developing sleeve 11 to be delivered to the developing region opposite an image bearing member 1 via developing sleeve 11 to accomplish developing, and developer transported along the axial direction of developing sleeve 11 passes through opening 12*a* formed at one end of partition 12 so as to be introduced into the second transport path 13*b*.

In the second transport path 13*b* separated from developing sleeve 11, developer is mixed and transported by developer mixing and transporting member 140 in the opposite direction to the transport direction of first transport path 13*a*, and at the previously mentioned part of partition 12 with the reduced height, developer passes over the partition 12 and gradually enters the first transport path 13*a* such that developer is circulated between first transport path 13*a* and the part of partition 12 with the reduced height.

Second transport path 13*b* is provided with an inclination which makes the side of opening 12*a* lower and the opposite side higher, as shown in FIG. 4. According to this construction, developer is readily circulated between the first transport path 13*a* and second transport path 13*b*.

When the toner concentration in the developer is reduced as a result of developing, fresh toner is resupplied to toner replenishment unit 15 which extends from the opening 12*a* side of partition 12 at second transport path 13*b*, such that the resupplied toner is introduced from toner replenishment unit 15 to second transport path 13*b* by developer mixing and transport member 140 and is mixed and transported in the second transport path 13*b* together with developer previously passing through opening 12*a* into second transport path 13*b*.

In the developing device of the present embodiment, since the developer mixing and transporting members 140 provided in first transport path 13*a* and second transport path 13*b* have two spiral-shaped channels 142*a* and 142*b* formed by blade members 143 on the circumference of a rotating shaft 141, and restricting members 144 are provided between blade members 143 forming spiral-shaped channels 142*a* to restrict developer transport, whereas said restricting members 144 are not provided in the other spiral-shaped channel 142*b*, the speed of the developer transported along channel 142*a* provided with restricting members 144 is different from the speed of the developer transported along the other channel 142*b* when the developer is mixed and transported by said developer mixing and transporting members 140, thereby rapidly dispersing and mixing resupplied toner in developer within the developing device body 10 so as to rapidly achieve a uniform toner concentration in the developer.

Thus, resupplied toner is rapidly dispersed in developer and mixed therewith in developing device body 10, and since developer is mixed by the restricting member 144 in addition to said blade member 143, the resupplied toner is adequately mixed with the carrier in the developer so as to be rapidly charged, thereby preventing fog and irregular density in formed images.

Figure 7:
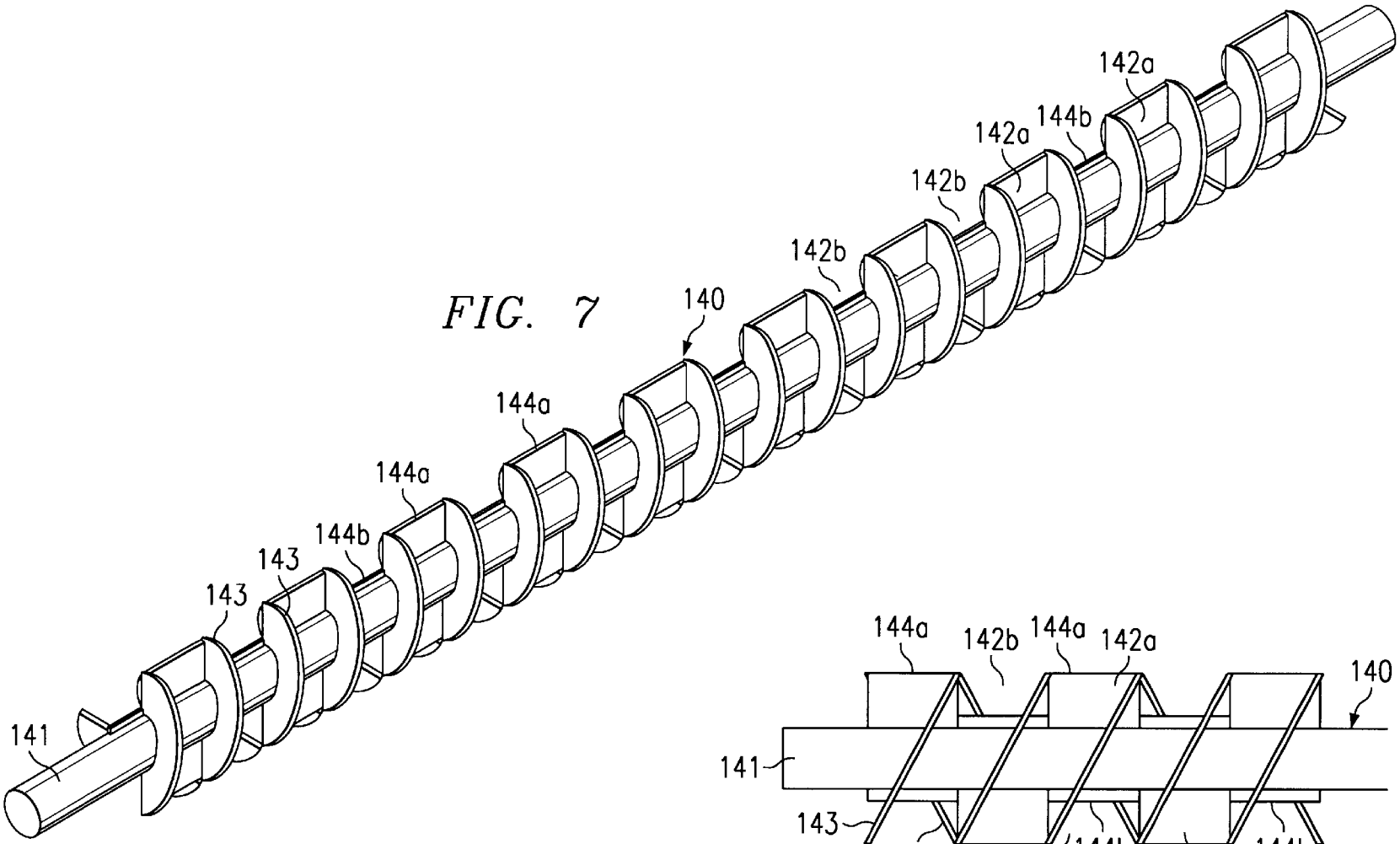
FIG. 7 is a brief perspective view of a modification of the developer mixing and transporting member used to mix and transport developer in the developing device of the same embodiment.
Figure 8:
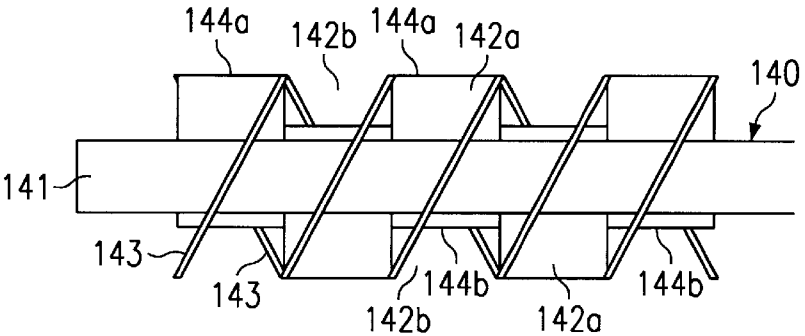
FIG. 8 is a partial view of a modification of the developer mixing and transporting member used to mix and transport developer in the developing device of the same embodiment.

Although the developer mixing and transporting member 140 is provided with restricting members 144 between blade members 143 forming one channel 142*a* among two spiral-shaped channels 142*a* and 142*b* formed by blade members 143 arranged on the circumference of a rotating shaft 141 in the developing device of the present embodiment, the developer mixing and transporting member 140 may be provided with restricting members 144*a* and 144*b* between the blade members 143 respectively forming the two spiral-shaped channels 142*a* and 142*b*, as shown in FIGS. 7 and 8, wherein the restricting members 144*a* of one channel 142*a* have the same height as blade member 143, and the other restricting members 144*b* of the other channel 142*b* have about ¼ the height of blade member 143, so as to produce different developer transport speeds along the channels 142*a* and 142*b*.

Furthermore, although two spiral-shaped channels 142*a* and 142*b* are formed by blade members 143 on the circumference of rotating shaft 141 in the developer mixing and transporting member 140 in the developing device of the present embodiment, more than two spiral-shaped channels 142 may be provided.

The developing device of the present embodiment is provided with a developer mixing and transporting member 140 having a first transport path 13*a* and second transport path 13*b* separated by a partition 12 in a developing device body 10, but it is possible to use various heretofore used developer mixing and transporting members wherein the developer mixing and transporting member 140 is provided with either first transport path 13*a* or second transport path 13*b*.

An experiment using the apparatus of the present invention is described next. A carrier alone was loaded in the first transport path 13*a* and second transport path 13*b* in the developing device of the present embodiment, and toner was resupplied from toner replenishment unit 15 to achieve a toner concentration in the developer of 5 percent-by-weight. Then, each of the aforesaid developer mixing and transport members 140 were rotated at 200 [rpm] to introduce resupplied toner into the second transport path 13*b* and mix and transport the toner with the carrier in the second transport path 13*b* so as to circulate the developer between first transport path 13*a* and second transport path 13*b*.

Figure 9:
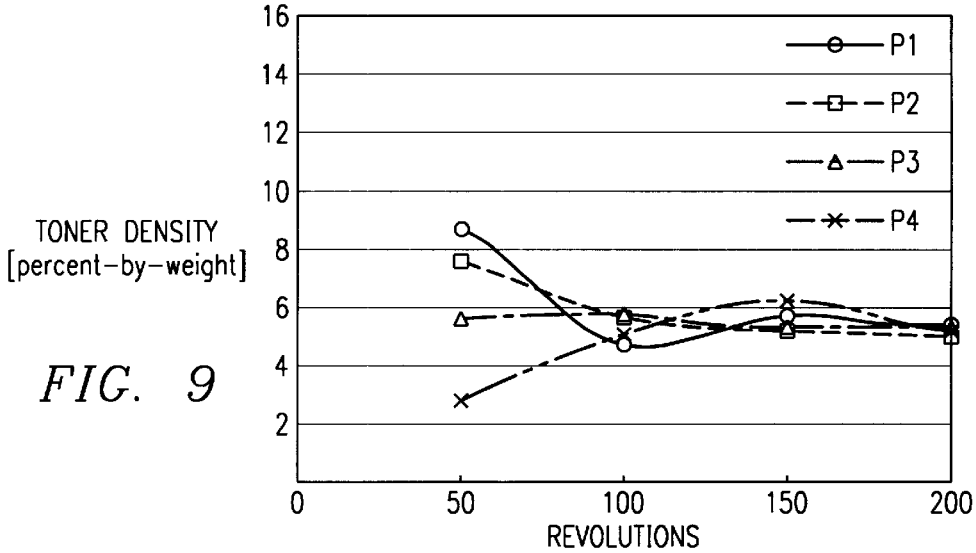
FIG. 9 shows the measured toner density in developer at points P1 through P4 on the developing sleeve when resupplied toner is dispersed in the developer via the rotation of the developer mixing and transporting member in the developing device of the same embodiment.

The toner concentration in the developer was measured at points P1 through P4 on developer sleeve 11 at predetermined intervals in the axial direction of developing sleeve 11 at various points in time of 50, 100, 150, and 200 revolutions of each of the aforesaid developer mixing and transporting members 140, to check the change in toner concentration in the developer at said points P1 through P4. The measurement results are shown in FIG. 9.

In the developing device of the present embodiment, there was extremely little difference in toner concentration in the developer at 100 revolutions of developer mixing and transporting member 140, and resupplied toner was rapidly and evenly dispersed in the developer.

Figure 1:
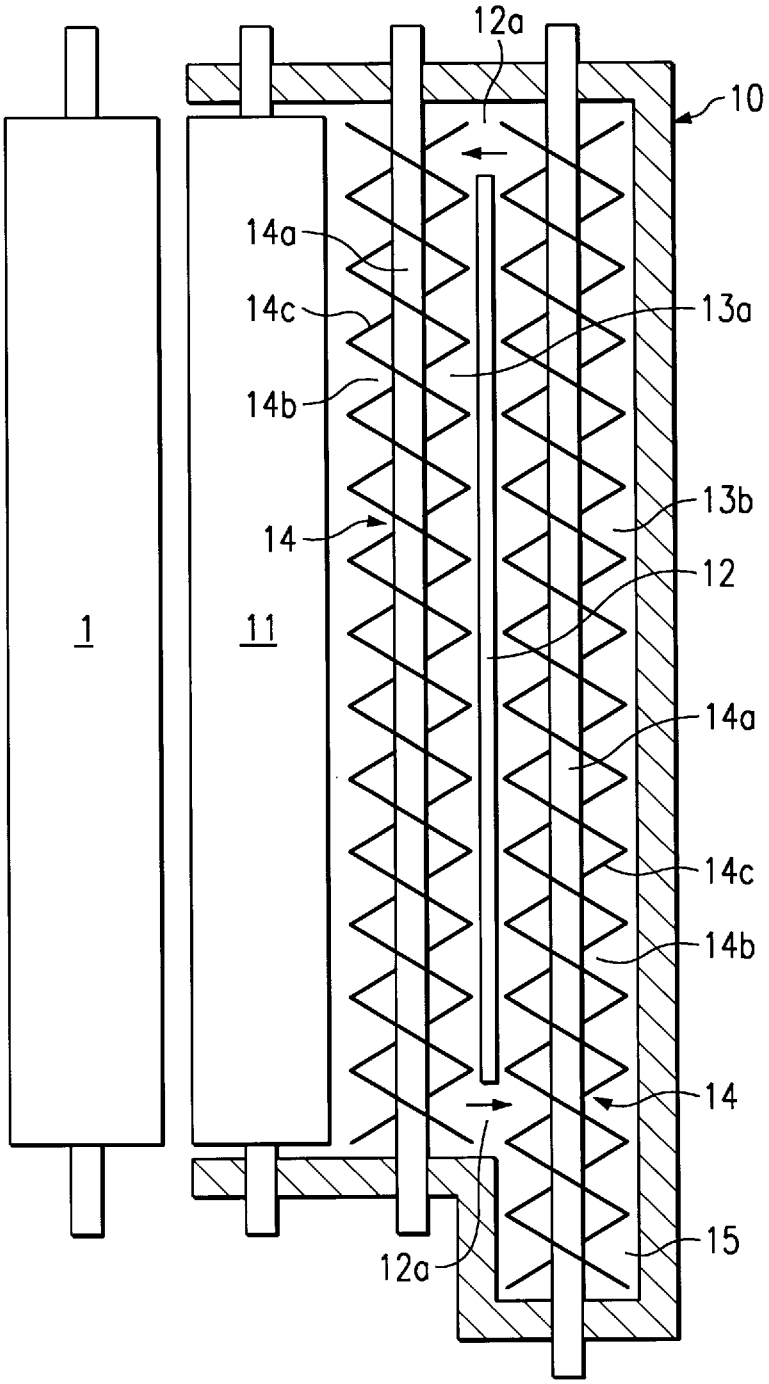
FIG. 1 (PRIOR ART)
FIG. 1 briefly shows developing by a conventional developing device.
Figure 2:
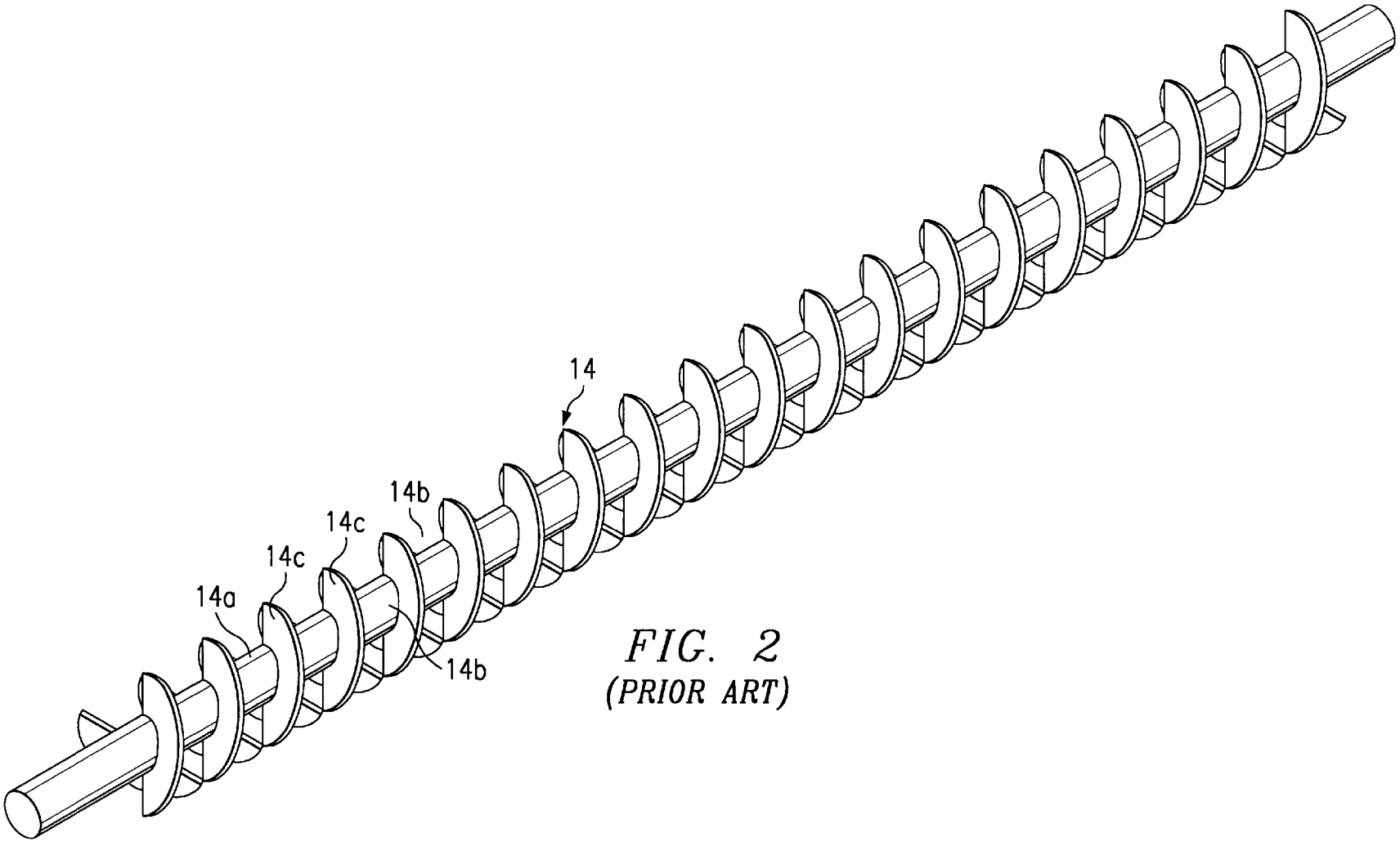
FIG. 2 (PRIOR ART)
FIG. 2 is a brief perspective view of a developer mixing and transporting member used to mix and transport developer in a conventional developing device.
Figure 11:
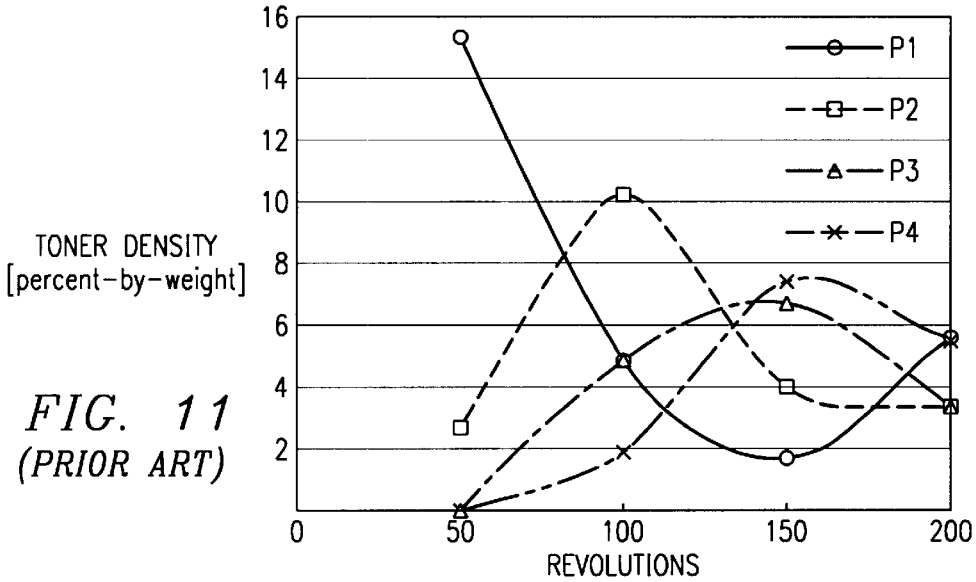
FIG. 11 (PRIOR ART)
FIG. 11 shows the measured toner density in developer at points P1 through P4 on the developing sleeve when resupplied toner is dispersed in the developer via the rotation of the developer mixing and transporting member in the developing device of reference example 1.
Figure 10:
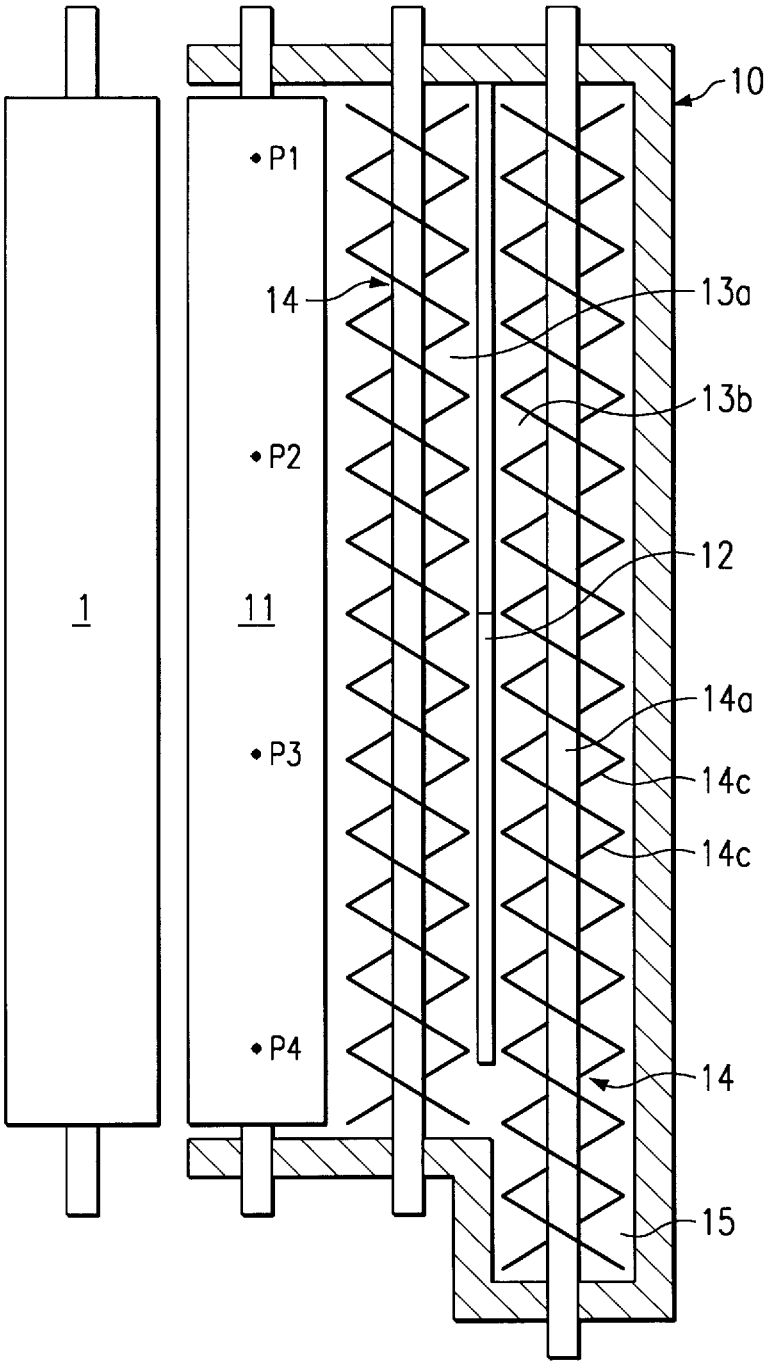
FIG. 10 (PRIOR ART)
FIG. 10 briefly shows the developing device of reference example 1 provided with conventional developer mixing and transporting members in each transport path.

For purposes of comparison with the developing device of the present embodiment, a reference example 1 was used which was substantially similar to the present embodiment with the exception that it was provided with conventional developer mixing and transporting members 14 as shown in FIG. 2 in first transport path 13*a* and second transport path 13*b* as shown in FIG. 10. Toner concentration in the developer was measured at points P1 through P4 on developer sleeve 11 at predetermined intervals in the axial direction of developing sleeve 11 at various points in time of 50, 100, 150, and 200 revolutions of each of the aforesaid developer mixing and transporting members 14 to check the change in toner concentration in the developer at said points P1 through P4. The measurement results are shown in FIG. 11.

In the case of reference example 1, which used conventional developer mixing and transporting members 14 that were not provided with restricting members 144, there was broad variation of toner concentration in the developer at points P1 through P4 on developing sleeve 11 even after 200 revolutions of the developer mixing and transporting member 14. Furthermore, an extremely long time was required to attain uniform dispersion of resupplied toner in the developer.

Figure 13:
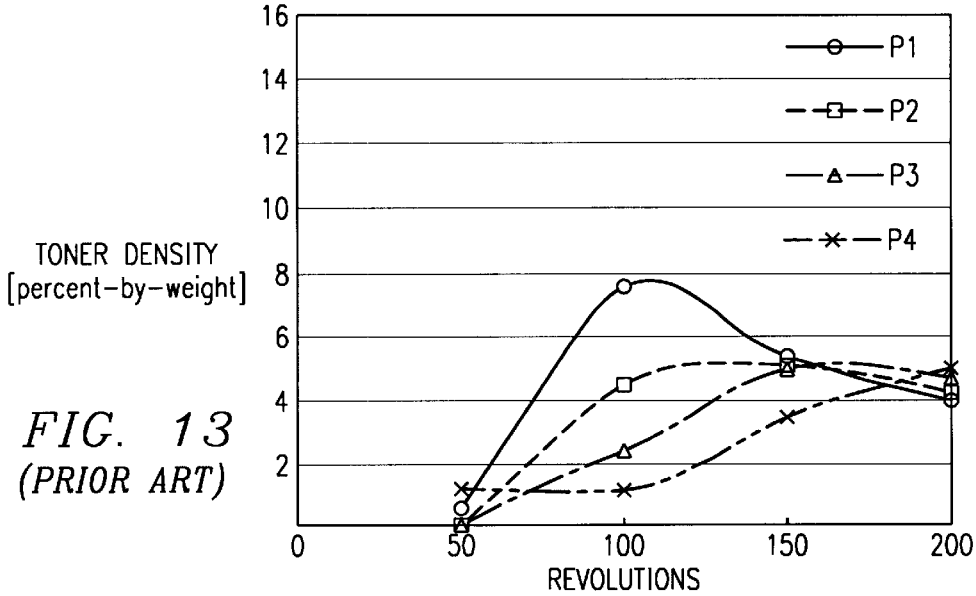
FIG. 13 (PRIOR ART)
FIG. 13 shows the measured toner density in developer at points P1 through P4 on the developing sleeve when resupplied toner is dispersed in the developer via the rotation of the developer mixing and transporting member in the developing device of reference example 2.
Figure 12:
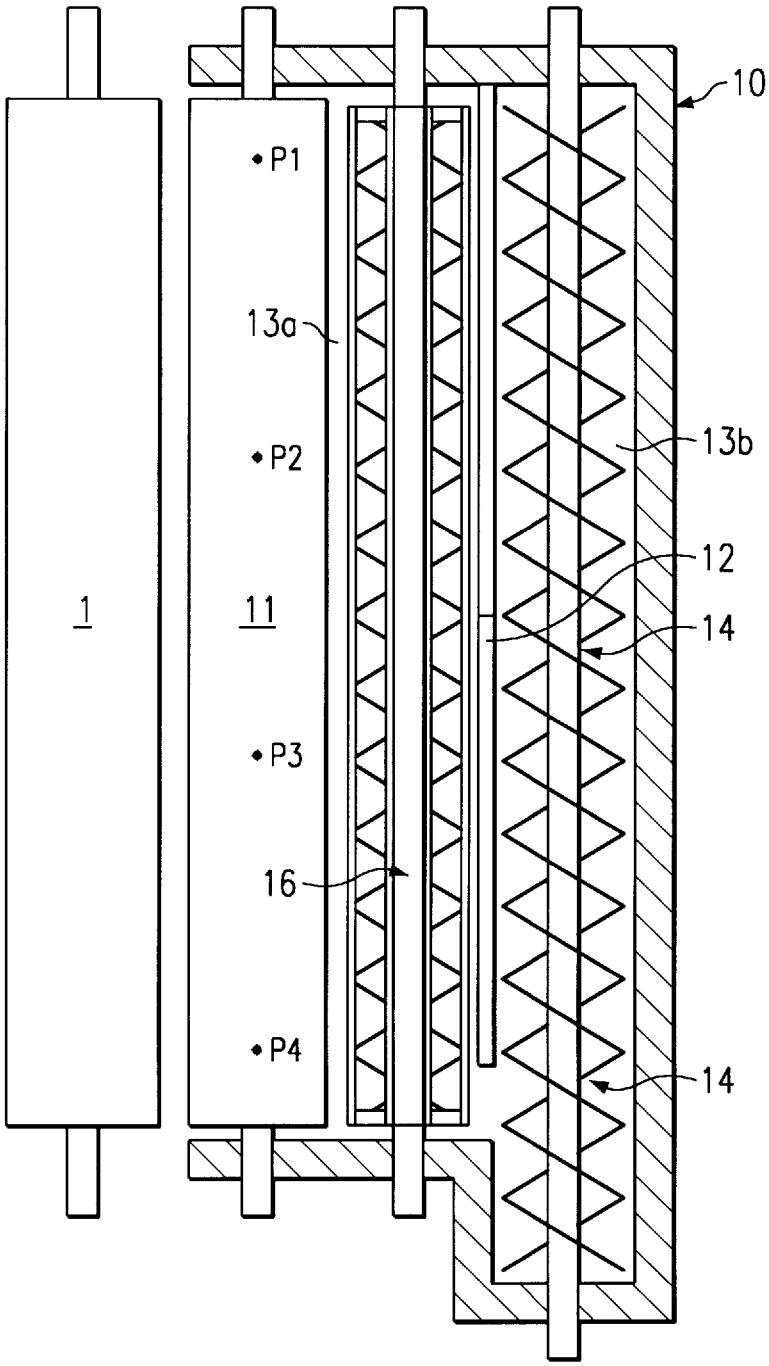
FIG. 12 (PRIOR ART)
FIG. 12 briefly shows the developing device of reference example 2 provided with a conventional developer mixing and transporting member and bucket roller in the transport paths.

For purposes of comparison with the developing device of the present embodiment, a reference example 2 was used which was substantially similar to the present embodiment with the exception that it was provided with a conventional developer mixing and transporting member 14 as shown in FIG. 2 in second transport path 13*a* and a conventional bucket roller 16 having a high ability to mix developer was used in first transport path 13*a*, as shown in FIG. 12. Toner concentration in the developer was measured at points P1 through P4 on developer sleeve 11 at predetermined intervals in the axial direction of developing sleeve 11 at various points in time of 50, 100, 150, and 200 revolutions of the aforesaid developer mixing and transporting members 14 and bucket roller 16 to check the change in toner concentration in the developer at the points P1 through P4. The measurement results are shown in FIG. 13.

Although toner concentration in the developer was uniformly dispersed at after points P1 through P4 at 200 revolutions when using the conventional bucket roller 16 having a high ability to mix developer in first transport path 13*a*, and the time required to evenly disperse resupplied toner in the developer was shorter than that required in reference example 1 which used only a conventional developer mixing and transporting member 14, more time was still required to uniformly disperse resupplied toner in the developer than was required by the developing device of the present embodiment.

Obviously, many modifications and variation of the present invention are possible in light of the above teachings. It is therefore to be understood that within the scope of the appended claims, the invention may be practiced other than as specifically described.

What is claimed is:

1. A developing device which mixes and transports developer, comprising:

a mixing and transporting member;

plurality of channels provided on said mixing and transporting member to transport developer; and a restricting member provided within one channel of said plurality of channels to restrict developer transport.

2. A developing device as claimed in claim 1, wherein said mixing and transporting member is rotatably provided.

3. A developing device as claimed in claim 2, wherein said plurality of channels are provided on said mixing and transporting member in spiral-shaped around said mixing and transporting member.

4. A developing device as claimed in claim 1, wherein said developing device includes a plurality of mixing and transporting members.

5. A developing device as claimed in claim 4, further comprising a plurality of developer transport paths, each one of said plurality of mixing and transporting members being disposed in a different one of said plurality of developer transport paths.

6. A developing device as claimed in claim 5, further comprising a partition which is disposed between said plurality of mixing and transporting members.

7. A developing device as claimed in claim 6, wherein a space is formed in said partition, said space permitting communication between said plurality of developer transport paths.

8. A developing device in accordance with claim 1, wherein said mixing and transporting member has first and second ends and wherein each of said plurality of channels extends substantially from said first end of said second end.

9. A developing device in accordance with claim 8, wherein said plurality of channels are substantially coextensive.

10. A developing device in accordance with claim 1, wherein said mixing and transporting member includes a plurality of spiral blades, said blades defining said plurality of channels.

11. A developing device which mixes and transports developer, comprising:

a mixing and transporting member;

plurality of channels provided on said mixing and transporting member to transport developer;

a first restricting member provided within one channel of said plurality of channels to restrict developer transport; and a second restricting member provided within a second channel of said plurality of channels, a size of said second restricting member being different from a size of said first restricting member.

12. A developing device which mixes and transports developer, comprising:

a mixing and transporting member which is rotatably provided;

a first channel provided on said mixing and transporting member to mix and transport developer at a first transport speed; and a second channel provided on said mixing and transporting member is mix and transport developer at a second transport speed, said first transport speed being different than said second transport speed.

13. A developing device as claimed in claim 12, wherein said first and second channels are provided on said mixing and transporting member in spiral-shaped around said mixing and transporting member.

14. A developing device as claimed in claim 12 further comprising a restricting member which is formed within one channel of said first and second channels to restrict developer transport.

15. A developing device as claimed in claim 12, wherein said developing device includes a plurality of mixing and transporting members.

16. A developing device as claimed in claim 15, further comprising a plurality of developer transport paths, each one of said plurality of mixing and transporting members being disposed in a different one of said plurality of developer transport paths.

17. A developing device as claimed in claim 16, further comprising a partition which is disposed between said plurality of mixing and transporting members.

18. A developing device as claimed in claim 17, wherein a space is formed in said partition, said space permitting communication between said plurality of developer transport paths.

19. A developing device in accordance with claim 12, wherein said mixing and transporting member has first and second ends and wherein said first and second channels each extend substantially from said first end to said second end.

20. A developing device which mixes and transports developer, comprising:

a mixing and transporting member which is rotatably provided;

a first channel provided on said mixing and transporting member to mix and transport developer at a first transport speed;

a second channel provided on said mixing and transporting member to mix and transport developer at a second transport speed, said first transport speed being different than said second transport speed; and restricting members which are formed within channels of said first and second channels to restrict developer transport, a size of said restricting members formed within said first channel being different than a size of said restricting members formed within said second channel.

* * * * *

UNITED STATES PATENT AND TRADEMARK OFFICE

CERTIFICATE OF CORRECTION

PATENT NO. : 5,842,090

DATED : November 24, 1998

INVENTOR(S) : Susumu Mikawa

It is certified that error appears in the above-identified patent and that said Letters Patent is hereby corrected as shown below:

Column 7, Line 33; delete "end of" and insert --end to--.

Column 8, Line 7; delete "member is" and insert --member to--.

Signed and Sealed this

Third Day of April, 2001

*Attest:*

Nicholas P. Godici

NICHOLAS P. GODICI

*Attesting Officer*

*Acting Director of the United States Patent and Trademark Office*